US006784353B1

(12) United States Patent
Davis

(10) Patent No.: US 6,784,353 B1
(45) Date of Patent: Aug. 31, 2004

(54) MUSICAL INSTRUMENT STRINGER/TUNER DEVICE

(76) Inventor: Eric Davis, 5130 Adalis Dr., Elk Grove, CA (US) 95758

( * ) Notice: Subject to any disclaimer, the term of this patent is extended or adjusted under 35 U.S.C. 154(b) by 37 days.

(21) Appl. No.: 10/345,451

(22) Filed: Jan. 17, 2003

(51) Int. Cl.[7] ..... G10G 7/02

(52) U.S. Cl. ..... 84/454; 84/455; 84/458; 84/312 R

(58) Field of Search ..... 84/454, 455, 458, 84/312 R

(56) References Cited

U.S. PATENT DOCUMENTS 2,514,315 A * 7/1950 Dickerson ..... 84/454
3,058,384 A * 10/1962 Musser ..... 84/454
3,818,793 A * 6/1974 Round ..... 84/454
3,834,266 A 9/1974 Robinson
3,915,051 A * 10/1975 Kincaid ..... 84/317
D267,410 S 12/1982 Spercel
4,608,905 A 9/1986 Takabayashi
4,889,029 A 12/1989 St. Denis
5,388,496 A 2/1995 Miller et al.
5,767,429 A 6/1998 Milano et al.

* cited by examiner

*Primary Examiner*—Shih-Yung Hsieh

(57) ABSTRACT

A musical instrument stringer/tuner device for replacing the tuning pegs on guitars. The musical instrument stringer/tuner device includes a housing member being adapted to be attachable to a musical instrument and having top, side, end, and bottom walls with a plurality of openings being disposed through the top wall and a plurality of holes being disposed through the side walls through which is adapted to receive strings of the musical instrument; and also includes string holding/releasing assemblies including string clamping members being movably disposed in the housing member; and further includes drive assemblies for moving the string clamping members.

9 Claims, 4 Drawing Sheets

MUSICAL INSTRUMENT STRINGER/TUNER DEVICE

BACKGROUND OF THE INVENTION

1. Field of the Invention

The present invention relates to musical instrument stingers/tuners and more particularly pertains to a new musical instrument stringer/tuner device for replacing the tuning pegs on guitars.

2. Description of the Prior Art

The use of musical instrument stingers/tuners is known in the prior art. More specifically, musical instrument stingers/tuners heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,767,429; U.S. Pat. No. 5,388,496; U.S. Pat. No. 4,889,029; U.S. Pat. No. 4,608,905; U.S. Pat. No. 3,834,266; and U.S. Pat. No. Des. 267,410.

While these devices fulfill their respective, particular objectives and requirements, the aforementioned patents do not disclose a new musical instrument stringer/tuner device. The prior art includes peg members being threaded into the musical instruments and to which the strings are wound.

SUMMARY OF THE INVENTION

The general purpose of the present invention, which will be described subsequently in greater detail, is to provide a new musical instrument stringer/tuner device which has many of the advantages of the musical instrument stingers/tuners mentioned heretofore and many novel features that result in a new musical instrument stringer/tuner device which is not anticipated, rendered obvious, suggested, or even implied by any of the prior art musical instrument stingers/tuners, either alone or in any combination thereof. The present invention includes a housing member being adapted to be attachable to a musical instrument and having top and side walls with a plurality of openings being disposed through the top wall and a plurality of holes being disposed through the side walls through which is adapted to receive strings of the musical instrument; and also includes string holding/releasing assemblies including string clamping members being movably disposed in the housing member; and further includes drive assemblies for moving the string clamping members. None of the prior art includes the combination of the elements of the present invention.

There has thus been outlined, rather broadly, the more important features of the musical instrument stringer/tuner device in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new musical instrument stringer/tuner device which has many of the advantages of the musical instrument stingers/tuners mentioned heretofore and many novel features that result in a new musical instrument stringer/tuner device which is not anticipated, rendered obvious, suggested, or even implied by any of the prior art musical instrument stingers/tuners, either alone or in any combination thereof.

Still another object of the present invention is to provide a new musical instrument stringer/tuner device for replacing the tuning pegs on guitars.

Still yet another object of the present invention is to provide a new musical instrument stringer/tuner device that is easy and convenient to set up and use.

Even still another object of the present invention is to provide a new musical instrument stringer/tuner device that reduces the amount of time needed to string and tune a guitar, in particular.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
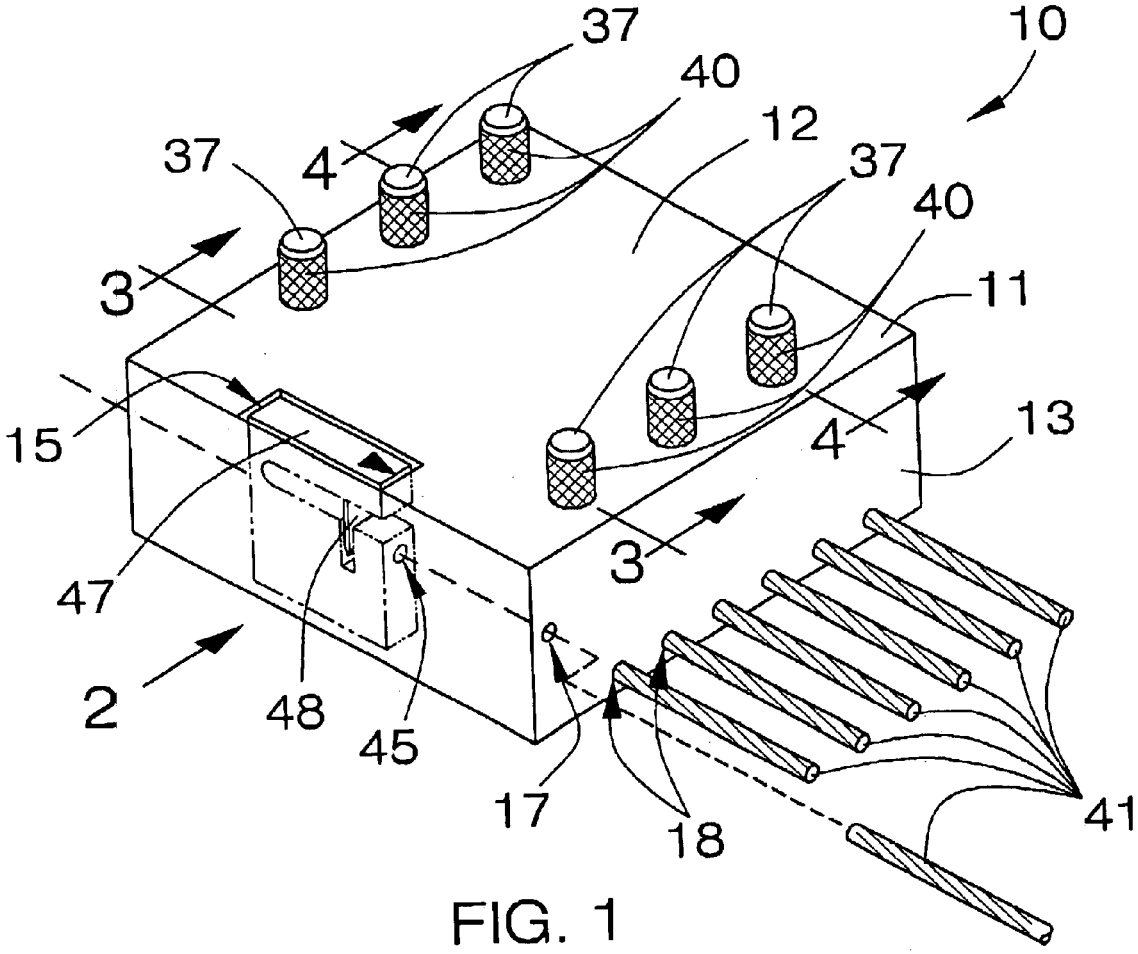
FIG. 1 is a perspective view of a new musical instrument stringer/tuner device according to the present invention.
Figure 2:
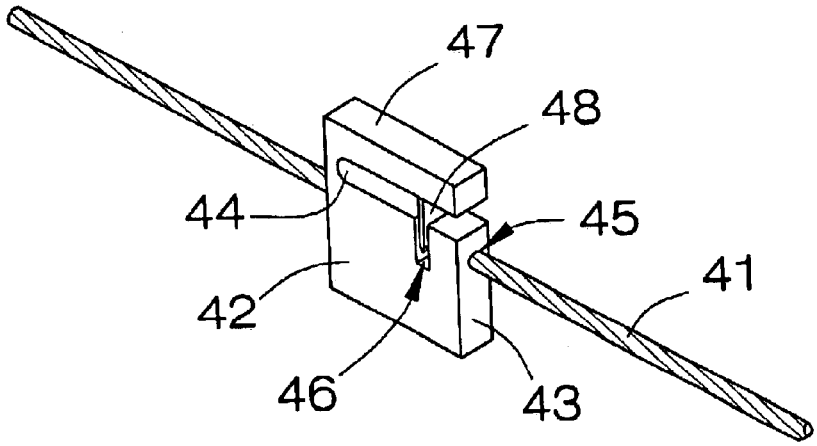
FIG. 2 is a perspective view of the string cutting assembly of the present invention.
Figure 5:
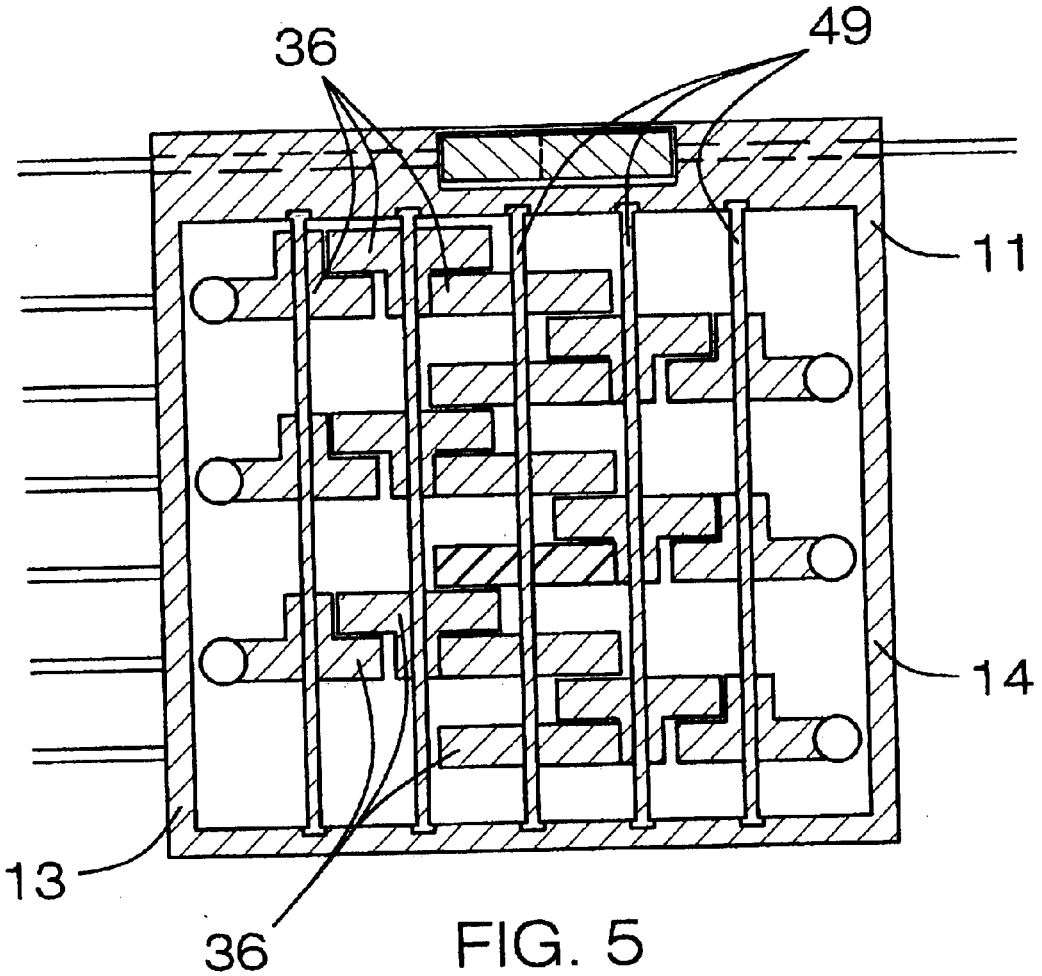
FIG. 5 is a top longitudinal cross-sectional view of the present invention.
Figure 3:
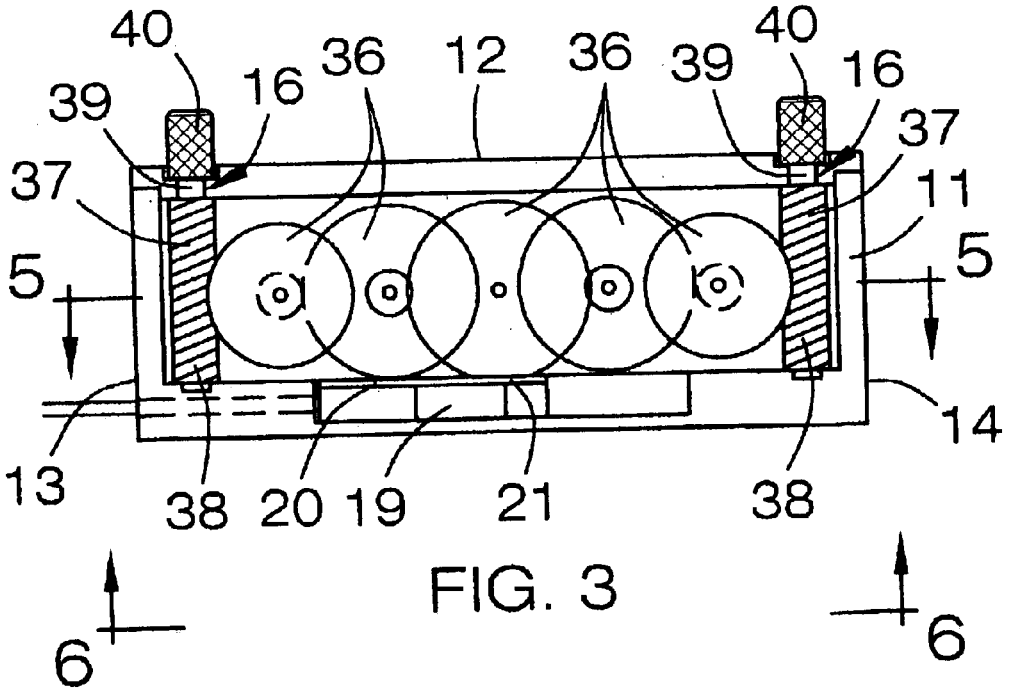
FIG. 3 is a lateral cross-sectional view of the present invention.
Figure 7:
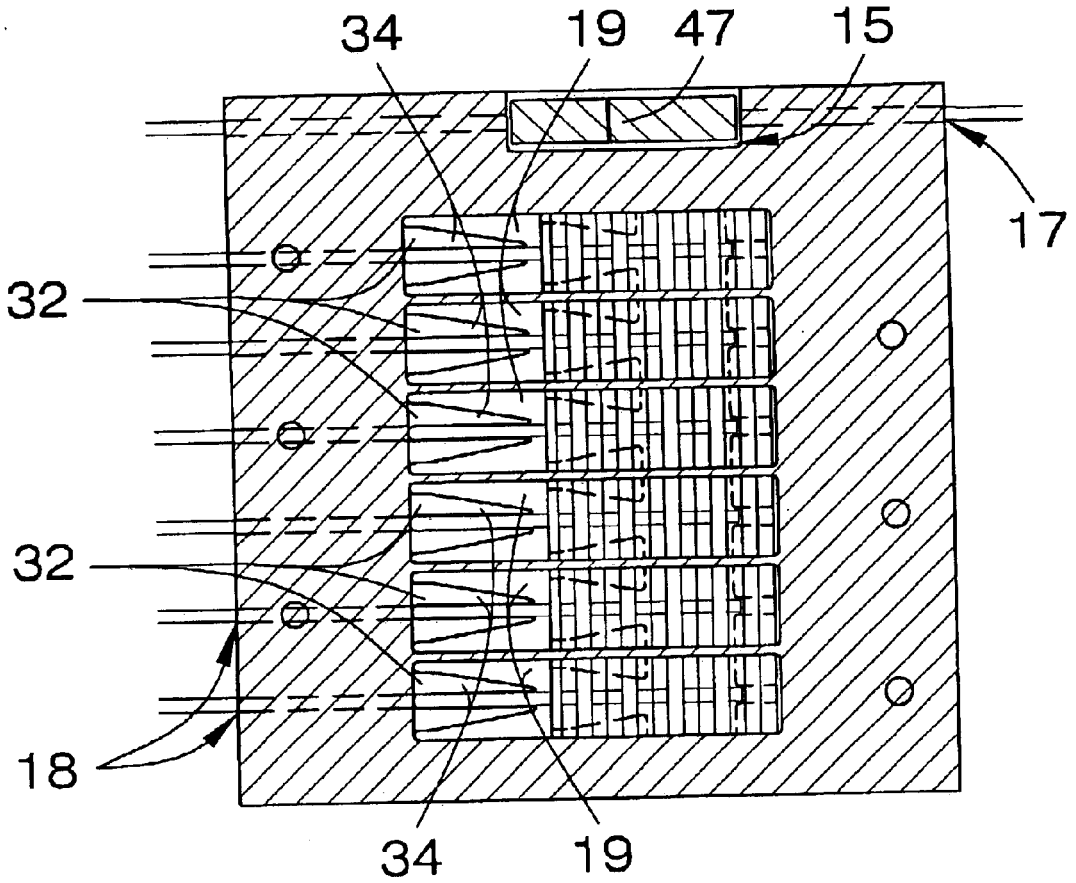
FIG. 7 is another top longitudinal cross-sectional view of the present invention.
Figure 4:
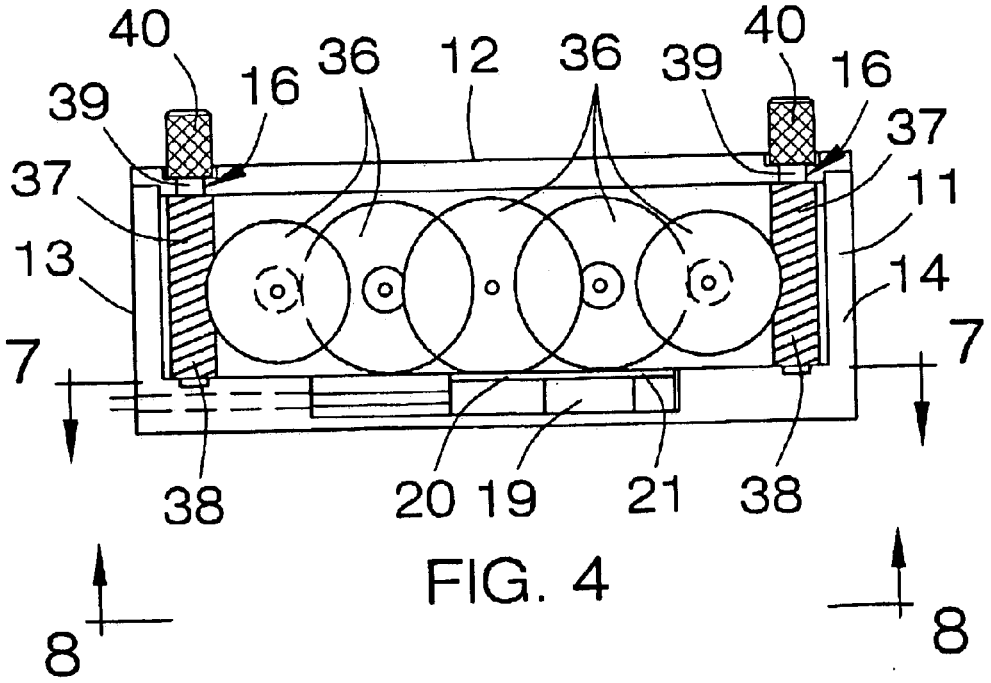
FIG. 4 is another lateral cross-sectional view of the present invention.
Figure 6:
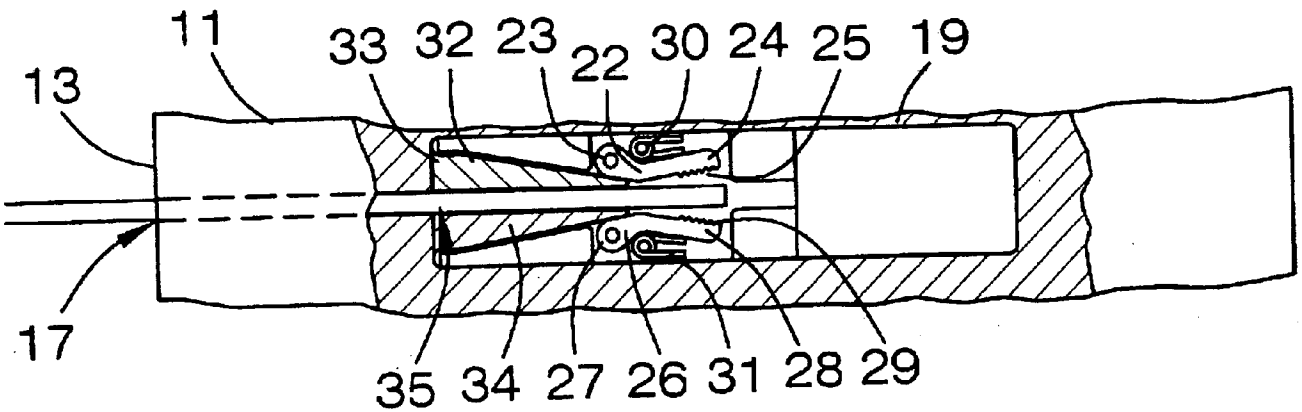
FIG. 6 is a bottom longitudinal cross-sectional view of the present invention.
Figure 8:
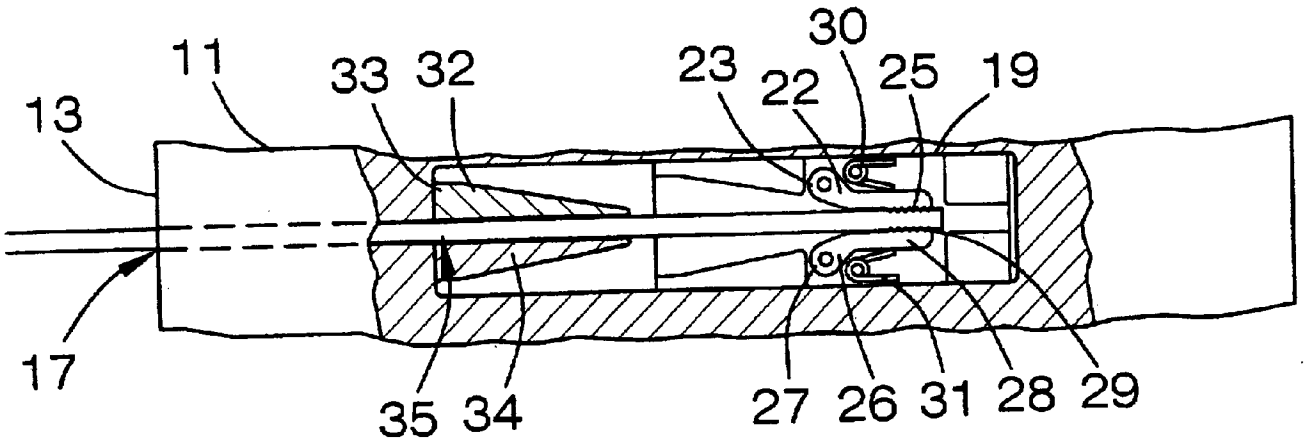
FIG. 8 is another bottom longitudinal cross-sectional view of the present invention.

With reference now to the drawings, and in particular to FIGS. 1 through 8 thereof, a new musical instrument stringer/tuner device embodying the principles and concepts of the present invention and generally designated by the reference numeral 10 will be described.

As best illustrated in FIGS. 1 through 8, the musical instrument stringer/tuner device 10 generally comprises a housing member 11 being adapted to be attachable to a musical instrument and having top and side walls 12–14 with a plurality of openings 16 being disposed through the top wall 12 and a plurality of holes 17,18 being disposed through the side walls 13,14 and through which is adapted to receive strings 41 of the musical instrument, and also having a slot 15 being disposed through the top wall thereof.

String holding/releasing assemblies include string clamping members being movably disposed in the housing member 11. Each of the string clamping members includes a support sleeve 19 being movably and conventionally disposed in the housing member 11 and being adapted to move about one of the strings 41 of the musical instrument, and also includes a pair of jaw members 22,26 being spacedly and conventionally disposed side by side in the support sleeve 19 and being adapted to receive one of the strings 41 therebetween and having first ends 23,27 which are pivotally and conventionally attached to the support sleeve 19, and further includes springs 30,31 being conventionally attached in the support sleeve 19 and biasing second ends 24,28 of the jaw members 22,26 together about the string 41, and also includes a string release member 32 being conventionally disposed in the housing member 11 for spreading apart the jaw members 22,26 to release the string 41. The support sleeve 19 has a wall 20 with a row of teeth 21 being conventionally disposed along an exterior thereof. Each of the jaw members 22,26 has teeth members 25,29 being conventionally disposed along an inner longitudinal edge at the second end 24,28 thereof for engaging the string 41. The springs 30,31 are leaf springs being conventionally attached to an interior of the wall 20 of the support sleeve 19. The string release member 32 has an enlarged first portion 33 and a narrowed second portion 34 being disposable between the jaw members 22,26 for spreading apart the jaw members 22,26, and also has a bore 35 extending therethrough and being adapted to receive the string 41 of the musical instrument therethrough.

Drive assemblies for moving the string clamping members each includes gear members 36 being rotatably and conventionally mounted about shafts 49 which are conventionally journaled in and to the housing member 11 with one of the gear members 36 being engaged with the row of teeth 21 of a respective support sleeve 19, and also includes a driver member 37 being engaged to one of the gear members 36 and being movably extended through a respective opening 16 of the housing member 11. The driver member 37 includes a worm gear portion 38 having helical threads being engaged to cogs of the particular gear member 36, and also includes a stem portion 39 which movably extends through a respective opening 16 of the housing member 11, and further includes a knob portion 40 being conventionally attached to the stem portion 39 and being exposed externally of the housing member 11 and being adapted to be grasped by a user to rotate the gear members 36 both to tighten the string 41 and to release the string 41.

A string cutting assembly is conventionally disposed in the housing member 11 for cutting strings 41 of the musical instrument as desired. The string cutting assembly includes a cutter support member 42 being conventionally disposed in the housing member 11 and having end walls 43 and also having a bore 45 extending therein through the end walls 43 and further having a slot 46 being disposed in a top 44 thereof and into the bore 45, and also includes a cantilevered lever 47 being depressibly and conventionally disposed in the slot 15 of said housing member 11 and having an end which is conventionally attached to the top 44 of the cutter support member 42 and having a main portion which is spaced above the top 44 of the cutter support member 42, and further includes a cutting member 48 being conventionally attached to the cantilevered lever 47 and being movably disposed in the slot 46 and being adapted to cut a string 41 being extended through one of the holes 17 of the housing member 11 and through the bore 45 of the cutter support member 42.

In use, to tune the musical instrument, the user turns the selected knob portions 40 of the drive members 37 to rotate the gear members 36 which move the support sleeve 19 and the jaw members 22,26 which are engaged about a particular string 41 to tighten the string 41 for tuning the musical instrument. To release the string 41, the user turns the particular knob portion 40 in the opposite direction which moves the support sleeve 19 to the particular string release member 32 which spreads the jaw members 22,26 apart to disengage the string 41 from therebetween. To cut the string 41, the user extends the end of the string 41 in the particular hole 17 of the housing member 11 where the cutter support member 42 is located and extends the string in the bore 45 of the cutter support member 42 and depresses upon the cantilevered lever 47 which is disposed in the slot 15 of the housing member 11 and which moves the cutting member 48 into the slot 46 and the bore 45 of the cutter member 42 thus cutting off a portion of the string 41 as desired.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the musical instrument stringer/tuner device. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A musical instrument stringer/tuner device comprising:

a housing member being adapted to be attachable to a musical instrument and having top and side walls with a plurality of openings being disposed through said top wall and a plurality of holes being disposed through said side walls through which is adapted to receive strings of the musical instrument, and also having a slot being disposed through said top wall thereof;

string holding/releasing assemblies including string clamping members being movably disposed in said housing member;

drive assemblies for moving said string clamping members; and a string cutting assembly being disposed in said housing member for cutting strings of the musical instrument as desired.

2. The musical instrument stringer/tuner device as described in claim 1, wherein each of said string clamping members includes a support sleeve being movably disposed in said housing member and being adapted to move about one of the strings of the musical instrument, and also includes a pair of jaw members being spacedly disposed side by side in said support sleeve and being adapted to receive one of the strings therebetween and having first ends which are pivotally attached to said support sleeve, and further includes springs being attached in said support sleeve and biasing second ends of said jaw members together about the string, and also includes a string release member being disposed in said housing member for spreading apart said jaw members to release the string.

3. The musical instrument stringer/tuner device as described in claim 2, wherein said support sleeve has a wall with a row of teeth being disposed along an exterior thereof.

4. The musical instrument stringer/tuner device as described in claim 3, wherein each of said jaw members has teeth members being disposed along an inner longitudinal edge at said second end thereof for engaging the string.

5. The musical instrument stringer/tuner device as described in claim 4, wherein said springs are leaf springs being attached to an interior of said wall of said support sleeve.

6. The musical instrument stringer/tuner device as described in claim 5, wherein said string release member has an enlarged first portion and a tapered second portion being disposable between said jaw members, and also has a bore extending therethrough and being adapted to receive the string of the musical instrument therethrough.

7. The musical instrument stringer/tuner device as described in claim 3, wherein each of said drive assemblies includes gear members being rotatably disposed about shafts which are journaled to and in said housing member with one of said gear members being engaged with said row of teeth of a respective said support sleeve, and also includes a driver member being engaged to one of said gear members and being movably extended through a respective said opening of said housing member.

8. The musical instrument stringer/tuner device as described in claim 7, wherein said driver member includes a worm gear portion having helical threads being engaged to cogs of one of said gear members, and also includes a stem portion which movably extends through a respective said opening of said housing member, and further includes a knob portion being attached to said stem portion and being exposed externally of said housing member and being adapted to be grasped by a user to rotate said first, second and third gears both to tighten the string and to release the string.

9. The musical instrument stringer/tuner device as described in claim 8, wherein said string cutting assembly includes a cutter support member being disposed in said housing member and having end walls and also having a bore extending through said end walls and further having a slot being disposed in a top thereof and into said bore, and also includes a cantilevered lever being depressibly and conventionally disposed in said slot of said housing member and having an end which is attached to a top of said cutter support member and having a main portion which is spaced above said top of said cutter support member, and further includes a cutting member being attached to said cantilevered lever and being movably disposed in said slot and being adapted to cut a string being extended through one of said holes of said hosing member and through said bore of said cutter support member.

* * * * *